United States Patent [19]

Kataoka et al.

[11] 4,113,416

[45] Sep. 12, 1978

[54] ROTARY BURNER

[75] Inventors: Rikio Kataoka; Shigeru Yano; Yoshito Kumamoto; Haruo Watanabe; Hisao Kaya, all of Kure; Kiyoshi Aoki, Chiba; Masanao Kitamura, Tokyo, all of Japan

[73] Assignee: Ishikawajima-Harima Jukogyo Kabushiki Kaisha, Ote, Japan

[21] Appl. No.: 771,665

[22] Filed: Feb. 24, 1977

[51] Int. Cl.[2] ..... F23D 11/04

[52] U.S. Cl. ..... 431/1; 431/168; 239/214.13; 239/214.19; 239/214.11

[58] Field of Search ..... 431/1, 168, 169, 351; 239/214.11–214.21

[56] References Cited

U.S. PATENT DOCUMENTS

| | | | |
|---|---|---|---|
| 1,613,539 | 1/1927 | Sheehy | 239/214.11 |
| 2,473,945 | 6/1949 | Gibson | 239/214.13 |

*Primary Examiner*—Carroll B. Dority, Jr.

*Attorney, Agent, or Firm*—Scrivener, Parker, Scrivener & Clarke

[57] ABSTRACT

Disclosed is a rotary burner of the type wherein the liquid fuel (to be referred to as "the oil" hereinafter in the specification) is atomized by uniform and stable ultrasonic waves and the oil particles are prevented from being sprayed outwardly so that the non-uniform distribution of concentrations of oil particles results, whereby the uniform combustion may be ensured.

13 Claims, 17 Drawing Figures

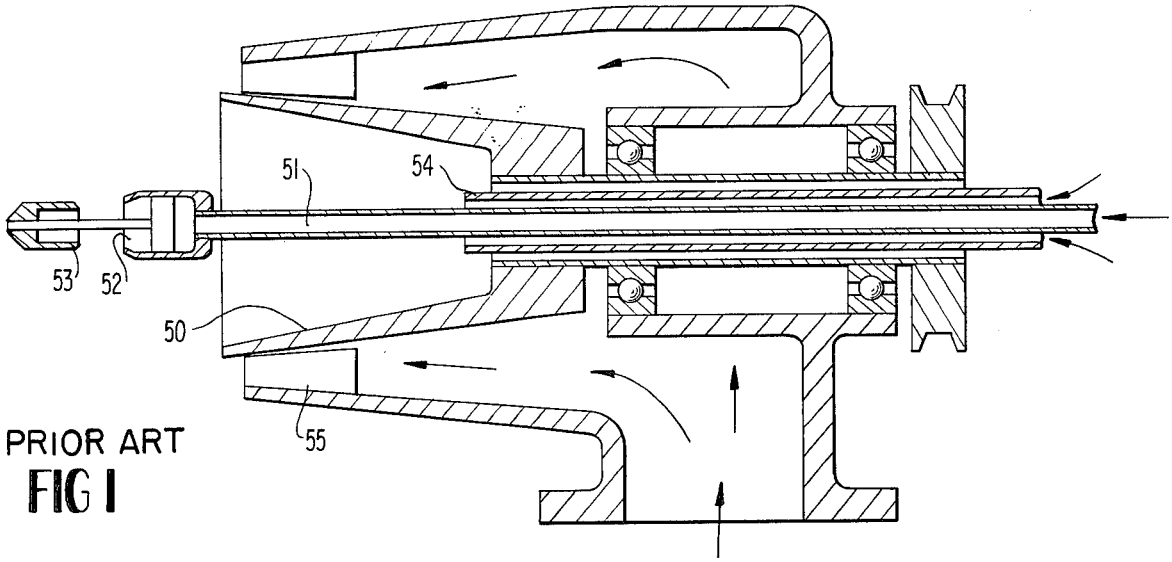
PRIOR ART
FIG 1
FIG 2
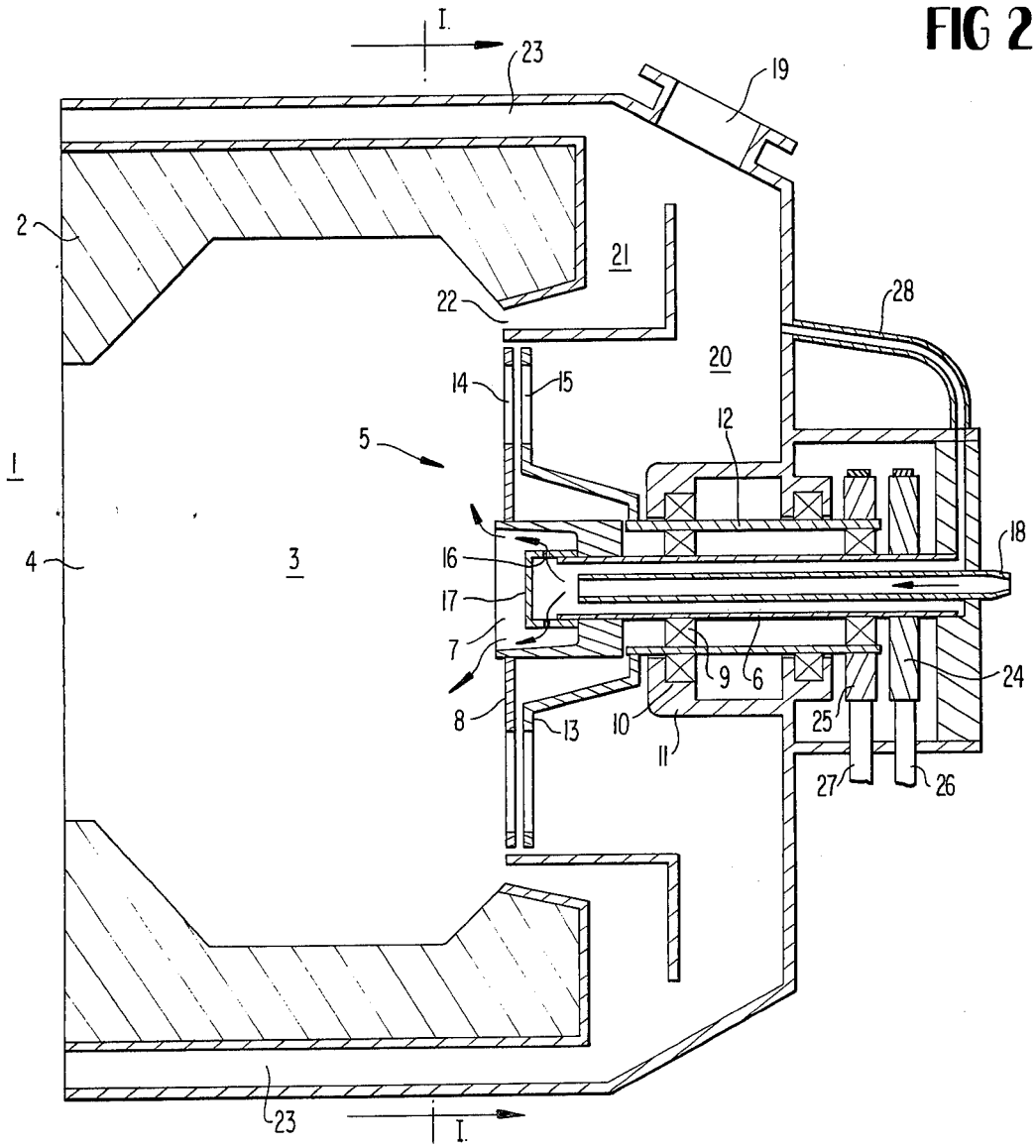

FIG 3
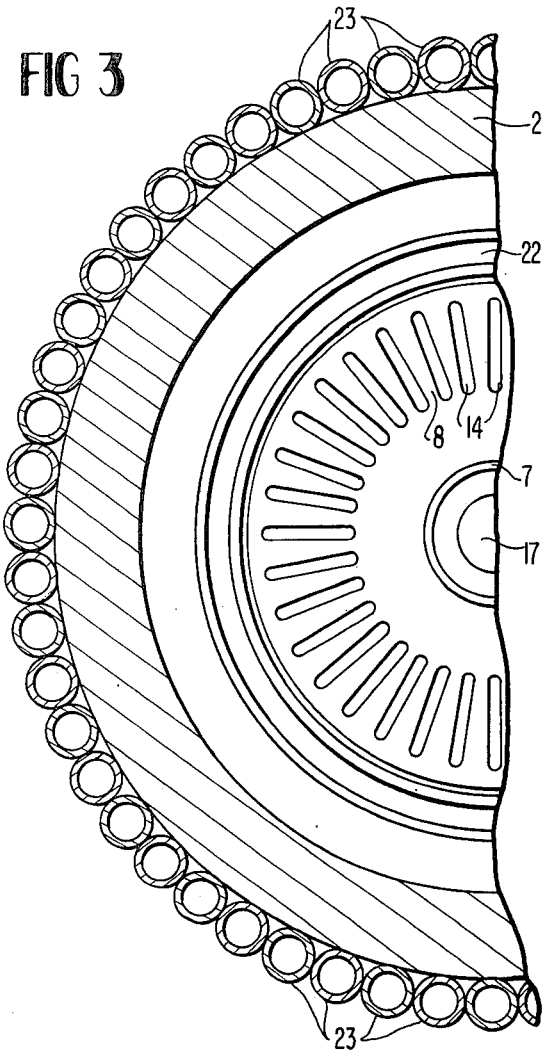
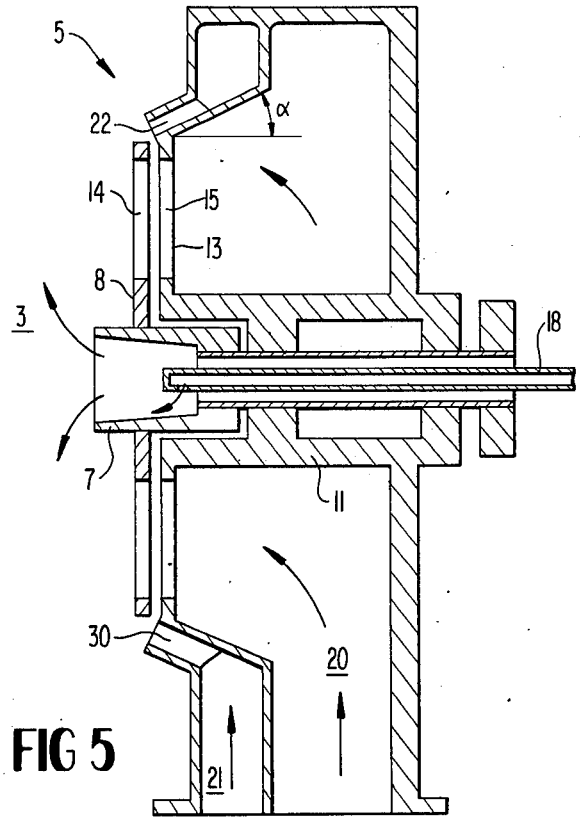
FIG 5
FIG 7a
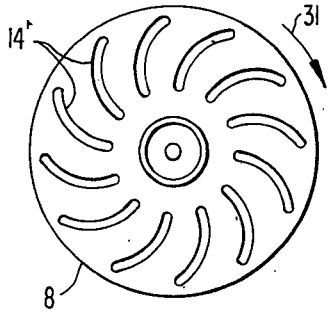
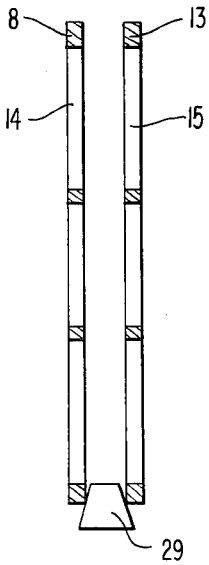
FIG 4
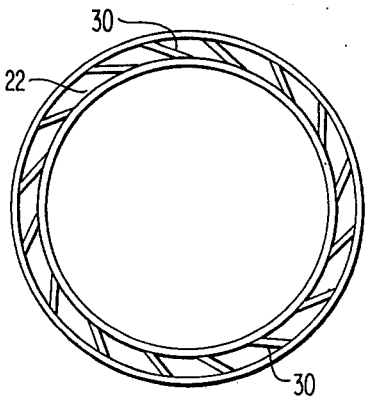
FIG 6
FIG 7b
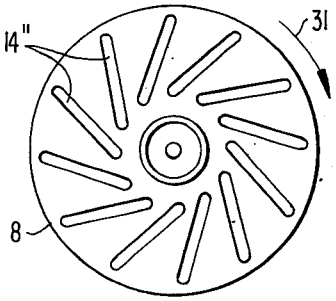

ROTARY BURNER

DETAILED DESCRIPTION OF THE INVENTION

Prior Art

In FIG. 1 there is shown a conventional rotary burner of the type having a cup-shaped resonator 53 forwardly spaced apart from an air injection nozzle or outlet 52 at the front end of an air tube extended through an atomizing cup coaxially thereof. The flow of air under pressure is periodically charged into and out of the resonator 53 from the injection nozzle 52 so that the ultrasonic waves may be generated for atomizing the oil injected from an oil pipe 54 and sprayed in the form of a film from the rim of the atomizing cup 50 under the centrifugal force.

The rotary burner of the type described, however, has some problems to be described below. First, the uniform ultrasonic waves at a constant frequency cannot be generated so that the oil may not be uniformly atomized. The resonator 53 is placed in opposed relation with the air stream discharged from the injection nozzle 52 so that part of the kinetic energy of the air stream is uneconomically dissipated. Furthermore, since the resonator 53 or the source of the ultrasonic waves is located too far from the swirling flows of the oil flowing the rim of the atomizing cup 50 together with the air discharged from air nozzles 55, so that the oil atomizing effect of the ultrasonic waves is not sufficient and consequently sufficiently atomized oil particles cannot be produced. In addition, the ultrasonic waves are propagated circumferentially from the source or resonator 53 and act on the oil film produced by the centrifugal force of the atomizing cup 50, so that the atomized oil particles tend to be scattered outwardly and consequently the uniform distribution of the concentrations of the atomized oil particles cannot be obtained. As a result, non-uniform combustion proceeds and soot adheres to the furnace wall.

In view of the above, the present invention has for its object to provide a rotary burner which may substantially solve the above and other problems encountered in the prior art rotary burners and will become apparent from the following description of the preferred embodiments thereof taken in conjunction with the accompanying drawings, in which:

FIG. 1 is a sectional view of a prior art rotary burner;

FIG. 2 is a longitudinal sectional view of a first preferred embodiment of the present invention;

FIG. 3 is a cross sectional view taken along the line I—I of FIG. 2, only one half being shown;

FIG. 4 is a fragmentary sectional view of a second preferred embodiment of the type wherein front and rear rotary disks are rotated in the opposite directions each other;

FIG. 5 is a longitudinal sectional view of a third embodiment of the present invention;

FIG. 6 is a front view of a secondary air outlet or guide vane thereof;

Figure 8:
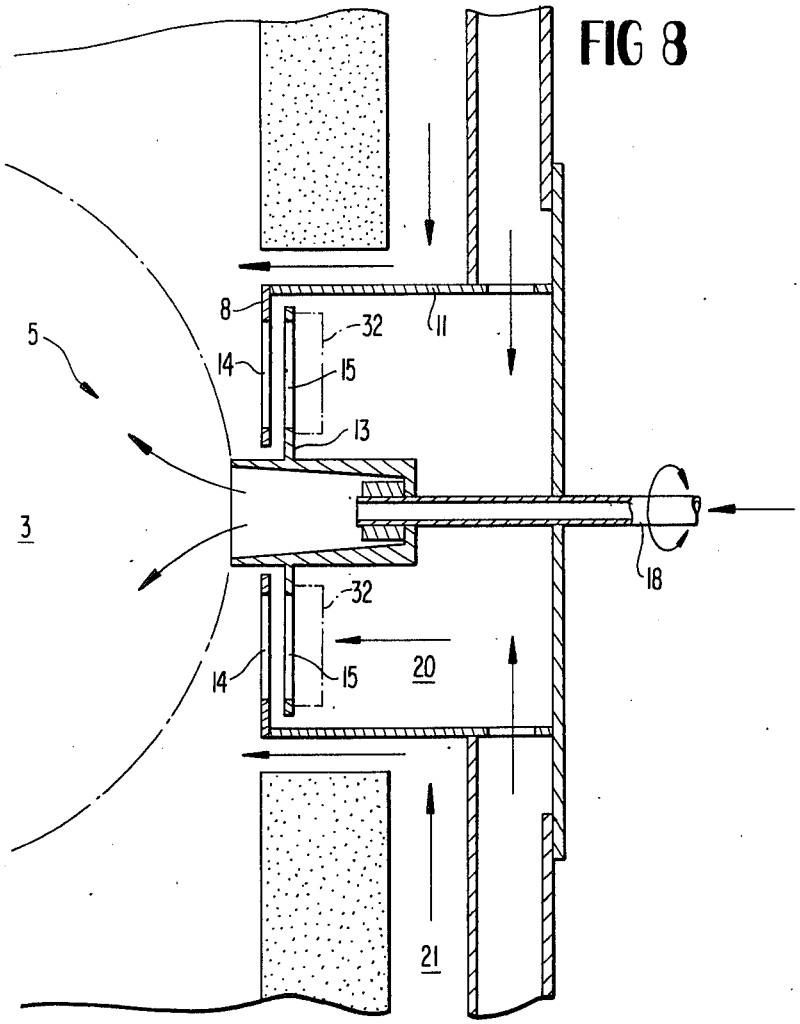
Figure 9:
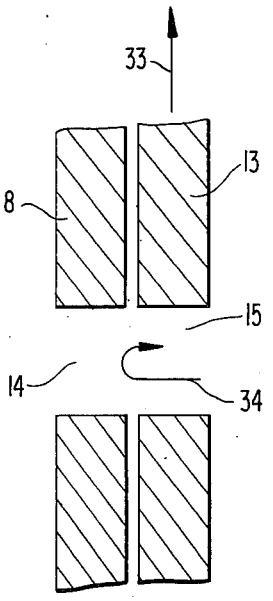
Figure 10:
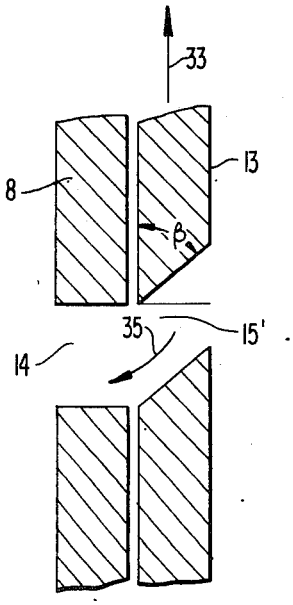
Figure 11:
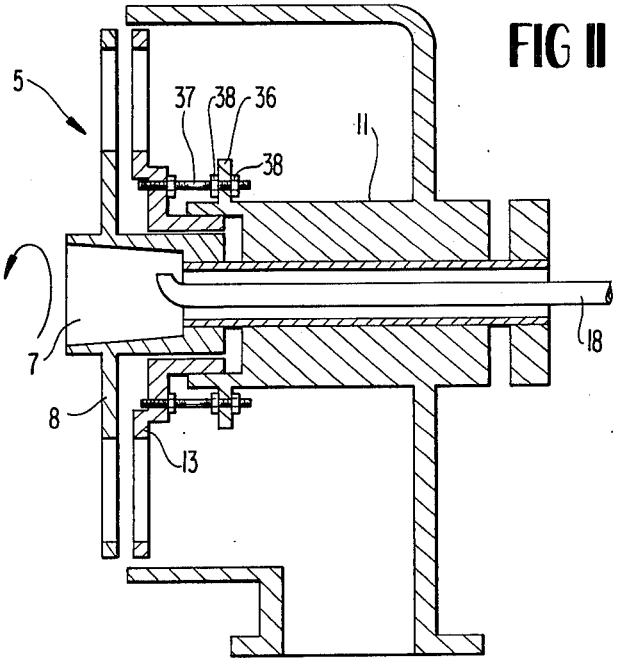
Figure 12:
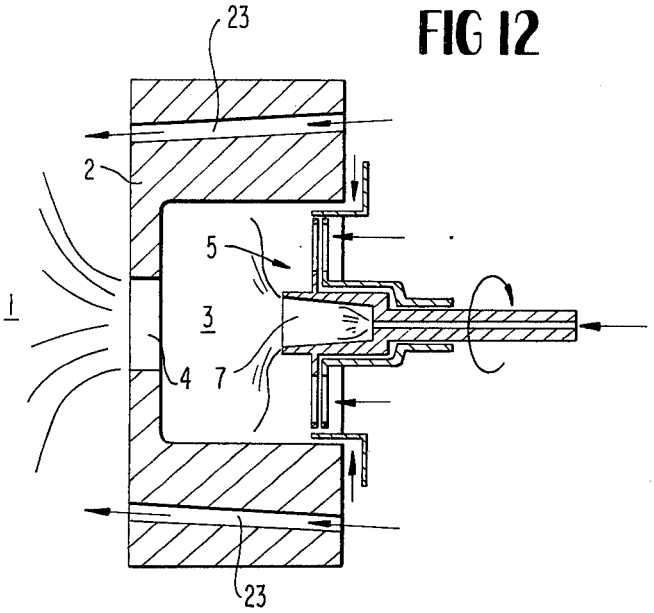
Figure 13:
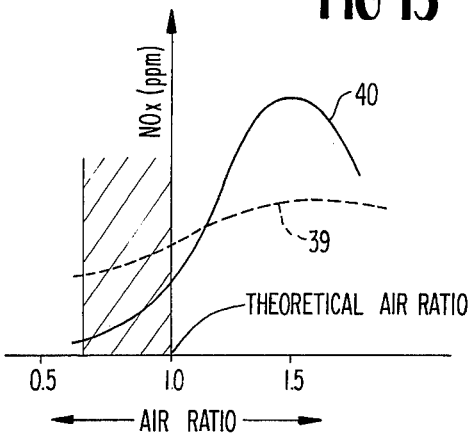
Figure 15:
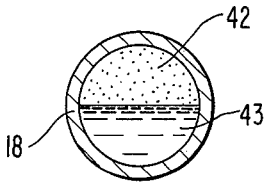
Figure 14:
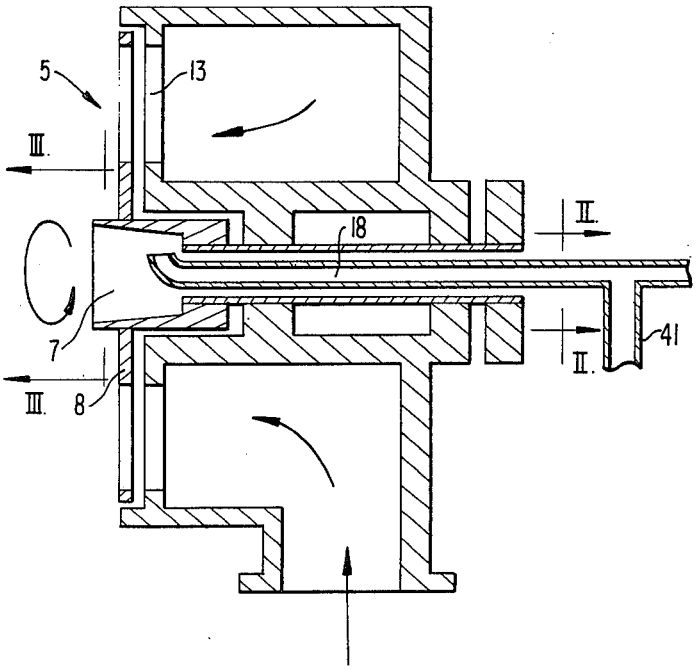
Figure 16:
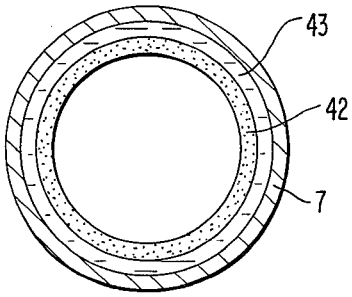

FIGS. *7a* and *7b* show the configurations of slits of the front rotary disk;

FIG. 8 is a longitudinal sectional view of a fourth preferred embodiment of the present invention;

FIG. 9 shows the configurations of the prior art slit;

FIG. 10 shows the configurations of the slits in accordance with the present invention;

FIG. 11 is a longitudinal sectional view of a fifth preferred embodiment of the present invention of the type wherein the spacing between the front and rear rotary disks may be adjusted;

FIG. 12 is a schematic view of a rotary burner used for the mode of operation of the rotary burners in accordance with the present invention;

FIG. 13 is a diagram also used for the explanation of the mode of operation;

FIG. 14 is a longitudinal sectional view of a sixth preferred embodiment of the present invention of the type wherein water is mixed with the fuel oil in order to decrease the combustion temperature, thereby reducing the emission of NOx or nitrogen oxides; and FIGS. 15 and 16 are cross sectional views taken along the lines II—II and III—III, respectively, of FIG. 14.

FIRST EMBODIMENT, FIGS. 2 AND 3

Referring to FIGS. 2 and 3 the first preferred embodiment of the present invention will be described in detail. A precombustion chamber 3 defined by a burner tile 2 is communicated with a furnace or main combustion chamber through a constricted or reduced-diameter passage 4, and a rotary burner generally indicated by the reference numeral 5 is mounted at the rear opened end of the precombustion chamber 3.

The rotary burner 5 has a front rotary disk 8 mounted on an atomizing cup 7 which in turn is formed integral with an inner hollow shaft 6 at the front end thereof, and a rear rotary disk 13 carried by an outer hollow shaft 12 at the front end thereof, the outer shaft 12 being extended coaxially of the inner shaft 6 and supported by bearings 9 and 10 between the inner shaft 6 and a support member 11. The inner and outer rotary disks 8 and 13 are spaced apart from each other by a predetermined distance and have the same outer diameter and a plurality of equiangularly spaced radial slits 14 and 15.

An oil discharge or spray cap 17 which is fitted over the front end of the inner hollow shaft 6 is formed with a plurality of equiangularly spaced oil spray nozzles 16 for uniformly spraying the oil along the inner surface of the atomizing cup 7, and an oil supply pipe 18 is extended through the inner hollow shaft 6 coaxially thereof and communicated with the oil spray cap 17.

The air drafted through an air inlet port 19 into the rotary burner 5 is divided to flow through a primary air passage 20 communicated through the slits 15 and 14 of the rear and front rotary disks 13 and 8 with the precombustion chamber 3, a secondary air passage 21 communicated with an annular secondary air outlet which is located circumferentially outwardly of the tips of the rotary disks 8 and 13 and which discharges the helically swirling secondary air flows into the precombustion chamber 3 and a plurality of tertiary air passages or pipes 23 mounted on the burner tile 2 in intimate contact with each other as best shown in FIG. 3 for supplying further combustion air into the furnace or main combustion chamber 1.

Pulleys 24 and 25 carried at the rear ends of the inner and outer shafts 6 and 13, respectively, are driving coupled through endless belts 26 and 27 to a prime mover (not shown) so that one of them may be driven or both of them driven in the opposite directions. Instead of the belt drive, a gear drive may be employed.

In order to prevent the leakage of the oil from the rear end of the inner shaft 6, an air seal system is provided. That is, part of the primary air flows through an air pipe 28 branched from the primary air passage 20 to the rear end of the inner shaft 6. However, the inner shaft 6 may be so designed as to serve as an oil supply pipe so that the oil supply pipe 18 as well as the air seal system or pipe 28 may be eliminated.

Next the mode of operation of the first embodiment with the above construction will be described. Either of the front or rear rotary disk 8 or 13 is driven or both of them are driven in the opposite direction, and the air is drafted through the air inlet 19 to flow through the primary air passage 20 toward the rear rotary disk 13. When the primary air passes through the slits 15 and 14 of the rear and front rotary disks 13 and 8, the ultrasonic waves are generated which in turn propagate into the precombustion chamber 3. The oil which is supplied through the oil supply pipe 18 is uniformly sprayed through a plurality of nozzles 16 around the periphery of the oil spray cap 17, and the oil which is sprayed outwardly in the form of film is atomized by the ultrasonic waves of the primary air so that the uniform precombustion proceeds in the precombustion chamber 3.

In this case it should be noted that the precombustion is critically dependent upon the rotational speed of the front or rear rotary disk 8 or 13. Since the front rotary disk 8 and the atomizing cup 7 are formed integral, the rotational speed of the atomizing cup 7 increases in proportion to the increase in rotational speed of the front rotary disk 8 so that the oil particles sprayed from the front rim of the atomizing cup 7 is accelerated by the centrifugal force and scattered outwardly without being atomized by the ultrasonic waves. In addition, the ultrasonic waves themselves are caused to propagate outwardly under the influence of the centrifugal force. As a result, the oil particles are caused to flow along the burner tile 2 and tend to adhere to it so that the uniform distribution of concentrations of the oil particles cannot be attained in the precombustion chamber 3.

Because of the reason described above it is preferable to rotate the front rotary disk 8 at a slower speed. However, the rotation of the front rotary disk 8 at a too lower speed results in the non-uniform of spray of the oil from the front rim of the atomizing cup 7. In addition the ultrasonic waves produced when the primary air passes through the slits 15 and 14 of the rear and front rotary disks 13 and 8 must be maintained at a constant frequency. Therefore the rotational speed of the rear rotary disk 13 must be faster than that of the front rotary disk 8. This may be easily attained by the adjustment of the rotational speeds of the pulleys 24 and 25.

The arrangement for driving both the front and rear rotary disks 8 and 13 in the opposite directions is advantageous over the arrangement for driving only one of them in that both the inner and outer shafts 6 and 12 share the driving force so that the loads exerted to them may be decreased and consequently they may be designed to be light in weight and to have a longer service life.

SECOND EMBODIMENT, FIG. 4

In the second embodiment shown in FIG. 4, a plurality of rollers 29 are interposed between the front and rear rotary disks 8 and 13 so that the disks may rotate in the opposite directions. According to the second embodiment, the independent adjustments of rotational speed of the front and rear rotary disks 8 and 13 cannot be made, but it has an advantage in that both the front and rear rotary disks 8 and 13 may be driven only by driving one of them by the prime mover and the relative rotational speed is twice as higher as that of one rotary disk which is powered.

THIRD EMBODIMENT, FIGS. 5 AND 6

The third embodiment shown in FIG. 5 is substantially similar in construction to the first embodiment shown in FIG. 2 except that the rear rotary disk 13 is not driven; that is, it is formed integral with the support member 11 as a stator and only the front rotary disk 8 is driven. As described above, the oil particles tend to be radially outwardly sprayed under the centrifugal force. To overcome this problem, the third embodiment provides a diffuser or secondary air outlet surrounding the front rotary disk 8 as shown in FIG. 5. In addition, in order to force the oil particles forwards, the axis of the secondary air flows through the diffuser or secondary air outlet ports 22 is inwardly downwardly inclined at an angle $\alpha$ as shown in FIG. 5. The diffuser has a row of inclined or spiral blades 30 so that the streamlined secondary flows may be charged into the precombustion chamber 3. Therefore the oil particles may be positively prevented from being sprayed outwardly within the precombustion chamber 3.

When only the front rotary disk 8 is driven as in the third embodiment just described above, it is preferable to form spiral-shaped slits 14' concaved in the direction indicated by the arrow 31 as shown in FIG. 7*a* in order to further prevent the outward spray of the oil particles. The rear disk or stator 13 is also formed with slits having the same configuration and pitch with those 14' of the front rotary disk 8 so that the ultrasonic waves at a constant frequency may be produced.

FOURTH EMBODIMENT, FIG. 8

In the fourth embodiment shown in FIG. 8, which is substantially similar in construction to the first embodiment, the front disk 8 is formed integral with a stationary member of a housing as a stator while only the rear rotary disk 13 is driven. The fourth embodiment is advantageous in that since the rear rotary disk 13 which is driven is disposed behind the stationary disk 8, the centrifugal force does not act on the oil particles. In addition the secondary air is charged from the secondary air outlets 21 so that the oil particles may be uniformly sprayed forwardly without being spreaded outwardly.

In the fourth embodiment, blades 32 may be attached to the rear surface of the rear rotary disk 13 between the slits 15 so that the rear rotary disk 13 may be driven by the primary air flowing through the primary air passage 20. This arrangement may eliminate the prime mover and its associated devices for driving the rear rotary disk 13.

With the slit 15 perpendicular to the surfaces of the rear rotary disk 13 which is rotated in the direction indicated by the arrow 33 in FIG. 9, the primary air tends to change the direction of its flow as indicated by the arrow 34 so that the uniform and stable ultrasonic waves at a predetermined frequency cannot be produced.

To solve this problem as shown in FIG. 10, the slit 15' of the rear rotary disk 13 is inclined at an angle $\beta$ to the flat surfaces of the rear rotary disk indicated by the arrow 33 so that the primary air may be forced into the slit 14 of the stator 8 as indicated by the arrow 35 and consequently the ultrasonic waves at a predetermined frequency may be generated. This slit arrangement may be equally applied to the front rotary disk 8 shown in FIG. 5.

FIFTH EMBODIMENT, FIG. 11

In the fifth embodiment shown in FIG. 11 the spacing between the front and rear rotary disks 8 and 13 may be adjusted so that the optimum ultrasonic waves may be generated. In this embodiment only the front rotary disk 8 is driven, and the rear rotary disk 13 is slidably mounted on the support member 11, and an externally threaded rod 37 is extended from the rear rotary disk 13 backwardly in parallel with the axis thereof and is screwed into an internally threaded hole drilled through an upright projection 36 extended from the support member 11 with adjusting nuts 38 screwed on the threaded rod 37 on both sides of the upright projection 36. Therefore the spacing between the front rotary disk 8 and the rear rotary disk 13 may be adjusted by loosening the adjusting bolts 38, moving the rear rotary disk 13 toward or away from the front rotary disk 8 and tightening the adjusting nuts 38. The front rotary disk 8 of the fourth embodiment may be similarly arranged to be moved toward or away from the rear rotary disk 13.

The primary object of the rotary burner in accordance with the present invention is to accomplish the optimum combustion first by uniformly atomizing the fuel oil by the ultrasonic waves. To this end the finely divided oil particles must be effectively vaporized, mixed with an oxidizing agent; that is, the air and burned as will be described in detail below with particular reference to FIGS. 12 and 13.

First in the precombustion chamber 3 it is preferable to proceed the combustion with as little oxygen as possible and at lower a temperature as possible because of the reason to be explained with particular reference to FIG. 13, where the ratio of air in the precombustion chamber 3 with respect to the theoretical air ratio quantity 1.0 is plotted while the NOx emission in ppm, along the ordinate. The air-NOx emission characteristic curve 39 is of the prior art rotary burner, whereas the characteristic curve 40, of the rotary burner in accordance with the present invention. It is seen that with the rotary burner in accordance with the present invention, the NOx emission is reduced less than one half of that of the prior art rotary burner when the air ratio is less than 1.0; that is, in the shaded area. Therefore the air ratio in the precombustion chamber 3 is maintained within a range indicated by the shaded area.

The products of the precombustion which are charged through the constricted passage 4 into the furnace or main combustion chamber 1 contain a large quantity of unburned compounds (mainly carbon monoxide CO in case of the hydrocarbon fuels) so that when they are burned, a large quantity of soot is produced, thus causing the air-pollution problem. To solve this problem, a large quantity of tertiary air is charged from the tertiary air passages 23 into the furnace or main combustion chamber 1 so as to ensure the complete combustion of the unburned products. Thus the optimum combustion with a less emission of NOx soot may be accomplished.

As described above, according to the present invention the precombustion proceeds in the precombustion chamber 3 and the products of the precombustion are charged through the restricted passage 4 into the furnace or main combustion chamber 1 while the tertiary air is injected through the tertiary air passages 23 so that the outward spread of the flame within the furnace or main combustion chamber 1 may be prevented. As a result, opposed to the prior art rotary burners, the adhesion of unburned compounds to the furnace walls may be minimized.

SIXTH EMBODIMENT, FIGS. 14, 15 AND 16

In the sixth embodiment shown in FIG. 14, in order to decrease the temperature in the precombustion chamber 3 and consequently to lower the NOx emission, water is added to the fuel. That is, a water supply pipe 41 is connected to the oil supply pipe 18 behind the rotary burner to add the water to the fuel so that the oil 42 and the water 43 flow in two layers as shown in FIG. 15 because of the difference in specific gravity therebetween. However, once they are sprayed into the atomizing cup 7, the water 43 forms the outer annular layer whereas the oil 42, the inner annular layer, and they are sprayed at a uniform ratio from the front rim of the atomizing cup 7 by the centrifugal force. In addition, they are atomized by the ultrasonic waves so that the temperature in the precombustion chamber 3 may be maintained at a lower level and consequently the emission of NOx may be minimized. Thus the sixth preferred embodiment provides the most simple means for minimizing the NOx emission, which is one of the most serious problems in various industries.

In summary, according to the present invention, the ultrasonic waves at a predetermined frequency may be generated in a stable manner for effectively atomizing the fuel, and the atomized oil particles may be effectively prevented from being sprayed outwardly with the resultant non-uniform distribution of concentrations of oil particles within the precombustion chamber. Therefore the uniform combustion may be ensured and the emission of NOx and soot may be considerably minimized.

It is to be understood that the present invention is not limited to the preferred embodiments described above with reference to the accompanying drawings and that various modifications may be effected without departing the true spirit of the present invention.

What is claimed is:

1. A rotary burner comprizing (a) a front rotary disk formed with a plurality of equiangularly spaced radially extended slits, (b) a rear rotary disk formed with a plurality of equiangularly spaced radially extended slits whose configurations and pitch are same with those of the slits of said front rotary disks, said front and rear rotary disks being coaxially arrayed and spaced apart from each other by a predetermined distance, (c) a combustion air supply passage for supplying the combustion air to pass through said slits of said rear and front rotary disks, (d) a fuel supply means for supply the liquid fuel to the center of either of said front or rear rotary disk, and (e) means whereby upon rotation of either one of said front and rear rotary disks or upon rotation of both of them in opposite directions, uniform and stable ultrasonic waves may be generated for uniformly atomizing the liquid fuel.

2. A rotary burner as set forth in claim 1 wherein the rotational speeds of said front and rear rotary disks may be adjusted independently of each other.

3. A rotary burner as set forth in claim 1 wherein said slits of said front and rear rotary disks are so formed that they register with each other and the comfigurations are same with each other.

4. A rotary burner as set forth in claim 1 wherein said rear rotary disk is stopped and only said front rotary disk is driven.

5. A rotary burner as set forth in claim 1 wherein said front rotary disk is stopped and only said rear rotary disk is driven.

6. A rotary burner comprising (a) a front rotary disk formed with a plurality of equiangularly spaced radially extended slits, (b) a rear rotary disk formed with a plurality of equiangularly spaced radially extended slits whose configurations and pitch are same with those of the slits of said front rotary disk, said front and rear rotary disks being coaxially arrayed and spaced apart from each other by a predetermined distance, (c) a combustion air supply passage for supplying the combustion air to pass through said slits of said rear and front rotary disks, (d) a fuel supply means for supply the liquid fuel to the center of either of said front or rear rotary disk, and (e) a precombustion chamber in front of said front rotary disk and in communication with a furnace or main combustion chamber.

7. A rotary burner as set forth in claim 6 wherein another combustion air supply means for directly supply a part of combustion air into said furnace or main combustion chamber.

8. A rotary burner comprising (a) a front rotary disk formed with a plurality of equiangularly spaced radially extended slits, (b) a rear rotary disk formed with a plurality of equiangularly spaced radially extended slits whose configurations and pitch are same with those of the slits of said front rotary disk, said front and rear rotary disks being coaxially arrayed and spaced apart from each other by a predetermined distance, (c) a combustion air supply passage for supplying the combustion air to pass through said slits of said rear and front rotary disks, (d) a fuel supply means for supply the liquid fuel to the center of either of said front or rear rotary disk, and (e) water supply means for mixing water into the liquid fuel.

9. A rotary burner as set forth in claim 8 wherein a water supply pipe is connected to said liquid fuel supply means.

10. A rotary burner as set forth in claim 1 wherein secondary air inlet means is provided which surrounds said front and rear rotary disks and which charges the air to a precombustion chamber.

11. A rotary burner as set forth in claim 5 wherein blades are attached to the rear surface of the rear rotary disk and said rear rotary disk is driven by the primary air fed to the rotary burner.

12. A rotary burner as set forth in claim 5 wherein the rear rotary disk is provided with opposite flat surfaces, the slits of the rear rotary disk being inclined at an angle $\beta$ with respect to said flat surfaces.

13. A rotary burner comprising:

(a) a front rotary disk formed with a plurality of equiangularly spaced radially extended slits, (b) a rear rotary disk formed with a plurality of equiangularly spaced radially extended slits whose configurations and pitch 6 are the same as those of the slits of said front rotary disk, said front and rear rotary disks being coaxially arrayed and spaced apart from each other by a predetermined distance, (c) a combustion air supply passage for supplying the combustion air to pass through said slits of said rear and front rotary disks, (d) a fuel supply means for supplying the liquid fuel to the center of either of said front or rear rotary disks, and (e) adjusting means for permitting the adjustment of the spacing of one of said rotary disks with respect to the other upon rotation of said one of the rotary disks while stopping the other.

* * * * *